United States Patent [19]

Colzani et al.

[11] Patent Number: 4,667,385

[45] Date of Patent: May 26, 1987

[54] LANCE FOR STIRRING MOLTEN METAL AND METHOD OF MAKING THE SAME

[75] Inventors: James W. Colzani, Menomonee Falls, Wis.; Nelson H. Kehl, Hinsdale, Ill.

[73] Assignee: Midwest Instrument Co., Inc., Hartland, Wis.

[21] Appl. No.: 768,854

[22] Filed: Aug. 23, 1985

[51] Int. Cl.[4] ..... C21C 5/48

[52] U.S. Cl. ..... 29/157 C; 29/423; 29/424; 29/458; 249/62; 264/59; 264/317; 266/225; 501/124

[58] Field of Search ..... 266/225, 233, 265, 266, 266/270; 75/59.3, 59.31; 249/62; 501/124; 264/59, 317; 29/157 C, 423, 424, 458

[56] References Cited

U.S. PATENT DOCUMENTS

| | | | |
|---|---|---|---|
| 2,535,100 | 12/1950 | Sourwine | 264/317 |
| 2,890,514 | 6/1959 | Doran et al. | 264/59 |
| 3,061,887 | 12/1962 | Clarke | 264/317 |
| 3,718,489 | 2/1973 | Crookston et al. | 501/124 |
| 4,367,868 | 1/1983 | Blom et al. | 266/225 |
| 4,396,179 | 8/1983 | LaBate | 266/220 |
| 4,449,701 | 5/1984 | Pitzer et al. | 266/270 |

*Primary Examiner*—L. Dewayne Rutledge
*Assistant Examiner*—Robert L. McDowell
*Attorney, Agent, or Firm*—Fuller, Puerner & Hohenfeldt

[57] ABSTRACT

For a molten metal stirring lance a steel tubular member is coated interiorly with wax, for instance, and a refractory material plug is cast in the member. The plug extends from one end of the member and leaves a clear space near the other end. Melting the wax out leaves a thin gas passageway gap around the plug. The end having the clear space is capped and connected to a gas feed pipe which is surrounded by a stiffener member. The latter member is convered with a refractory material protective sheath. The refractory material in the tubular member erodes or ablates by a small amount during each use in molten metal to keep the gas discharge gap clear.

3 Claims, 8 Drawing Figures

LANCE FOR STIRRING MOLTEN METAL AND METHOD OF MAKING THE SAME

BACKGROUND OF THE INVENTION

The invention disclosed herein relates to metal refining and particularly to a lance for injecting gas in a vessel containing molten metal to effect agitation and stirring of the metal.

In steel making, by way of example, it is customary to tap the refining furnace and let the melt flow into a refractory lined holding vessel for alloying and desulphurizing and performing other steps that are needed for the product to meet specifications. The melt is tapped when it is at a higher temperature than is optimum for ultimate utilization such as casting it into ingots or furnishing it to the tundish of a continuous casting machine. While undergoing alloying and other processing, the melt cools at a generally predictable rate and it has a tendency to develop strata having different chemical compositions and temperature gradients. Hence, stirring is required to make the melt as uniform as possible in all respects before it is poured from the holding vessel.

Stirring is usually effected by injecting a gas into the melt at a substantial distance below its surface. One prior method involves setting a porous plug of ceramic material in the refractory lined bottom of the holding vessel and forcing pressurized gas such as nitrogen or argon from the outside of the vessel through the plug. The resulting bubbles rise through the melt and induce circulation. The problem is that the action of the melt on the plug and the high temperature cause the pores at the surface of the plug where it interfaces with the metal to fuse and clog after use. Moreoever, when the melt is finally poured from the holding vessel some slag remains in the vessel and it bonds onto the plug and seals its pores. Consequently, after each use of the vessel a gas burning torch is used to burn away any accumulations on the plug and thereby expose a new clean porous surface. Porous plugs also erode after not many usages of the vessel to the point where replacement of the plug and rebuilding of the refractory bottom lining has to be undertaken.

Another prior scheme for stirring with gas used a ceramic plug set in the bottom refractory liner of the holding vessel but the plug was not porous. Rather, the plug was usually in the form of a truncated cone set in a complementarily shaped insert in the liner with spacers such that there was a small gap or free space around the surface of the cone. Thus, instead of relying on porosity of gas conduction, axial flow along the gap was used. While the integrity of the plug was maintained, gas evolved in a circular pattern from the end of the cone and entered the bottom of the melt for an upward ascent. However, this scheme turned out to have just about the same problems as the porous plug. As it eroded away, it imperiled the integrity of the vessel bottom so it and the bottom had to be replaced quite frequently. Residual slag froze over the circular gap exits and plugged the gap so the plug had to be burned clear between successive uses of the vessel as was formerly the case.

Before use of plugs in the bottom of a vessel became commonplace, lances were used to inject stirring gas into holding vessels. The first lance designs were essentially a pipe surrounded concentrically by a refractory material sheath. The open end of the pipe was positioned six inches, more or less, from the bottom of the vessel and the pressurized gas was forced out in opposition to the hydrostatic head of the molten metal. With this kind of lance the gas emitted from the lower end of the pipe flowed up through the melt in the form of large bubbles which did not agitate nor stir the melt effectively. Furthermore, when the large bubbles erupted from the molten metal surface they spewed and splashed molten metal which is undesirable.

Probably the most widely used gas stirring device in current use combines the lance and porous plug concept. A porous ceramic plug which has been fired and is dimensionally stable is encased in a metal cylinder which is connected to a long gas feed pipe. The pipe and cylinder are encased in a refractory material sheath to form a lance that is immersible throughout most of its length in molten metal. Pressurized gas fed down the pipe permeates the porous plug such that gas is emitted from the end of the plug in fine bubbles. Stirring effectiveness has been considered acceptable for the lack of anything better until the invention disclosed herein was made. However, the currently used lances still suffer plugging of the pores in the ceramic plug. Some clean-up work has to be done on them after each use if they are to be reused. Material has to be chipped away in order to restore porosity at the interface of the plug and the metal.

SUMMARY OF THE INVENTION

The invention disclosed herein is a gas bubbler used in a lance type structure. The bubbler comprises a tubular member, preferably made of steel, which is short compared to the total length of the lance. The method of making the new type of bubbler involves coating the interior of the tubular member with a thin coat of a volatizable or easily meltable material such as wax. A filler of easily removable material such as glass wool, cotton or the like is then packed into one end of the tubular member to serve as a dam which blocks one end of the member. The hollow tubular member which is bottomed with filler material is then filled with a refractory material having particular properties. After the refractory material is solidified and cured, the hollow member is heated to melt out or vaporize the sacrificial material, thus leaving a small gap between the perimeter of the cast refractory material plug and the interior surface of the hollow member. After removal of the filler material, a closure member is welded or otherwise fastened to the tubular member at the end which had the space occupied by the filler material. The closure member has an adaptor for connecting it to a gas feed pipe. The closed end space in the member thus constitutes a plenum chamber from which gas can flow through the gap along the sides of the refractory plug. The plug is formed of a refractory material that shrinks a little when it is heated so the gap is maintained.

After the bubbler is fabricated and tested for gap uniformity, it is connected to a long feed pipe and to a stiffener tube which surrounds the feed pipe and is coextensive therewith. This whole assembly is coated with a refractory clay protective sheath. After the sheath cures, the lance is ready to be used as a gas stirring device.

The bubblers of the new lances which were tested in molten metal holding vessels remained functional for a surprisingly large number of heats. The refractory plug eroded a little during each use but this is one of the merits of the new bubbler plug in that it is self-clearing at its edges such that the gaps remain clear and uniform after many uses. The degradation of the plug at the end exposed to the molten metal is caused by selection of an appropriate refractory material which erodes as a result of heating to bath temperatures and cooling.

A detailed description of an embodiment of the new molten metal agitating and stirring lance will now be set forth in reference to the accompanying drawing.

DETAILED DESCRIPTION OF THE EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
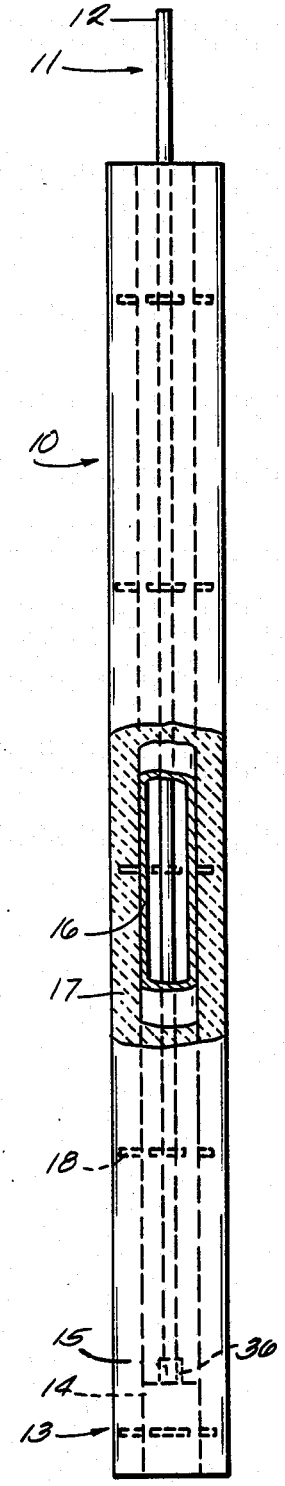
FIG. 1 is a diagrammatic view of a stirring lance in which the new bubbler described herein is employed.

FIG. 1 shows a diagram of a lance which injects an inert gas such as argon into a molten metal bath contained in a ladle for further processing such as desulphurizing and alloying. The lance, which is generally designated by the numeral 10, comprises a long central pipe 11 which, by means that are not shown, connects at its upper or proximal end 12 to a source of stirring gas. In use, the lower end 13 of the lance is held so that it is situated about six inches from the bottom of a ladle that is lined with refractory material. The new gas bubbler is shown diagrammatically in FIG. 1 at the lower end of the lance and is designated generally by the reference numeral 14. As shown in FIG. 1, the bubbler has a coupling into which the lower or distal end of gas feed pipe 12 is screwed to effect a gas tight joint. The feed pipe would be too flexible for the conditions under which the lance is used so it, in the illustrated design, is surrounded by a stiffener metal tube 16 which is welded onto the body of bubbler 14. Substantially the whole length of the lance is covered or encased by an outer wall 15 insulating material such as a refractory clay 17. This insulation covers the sides of the bubbler 14 as well but not its lower end. Some anchors 18 comprised of steel rod are welded to stiffener tube 16 and assist in causing the outer refractory clay sheath 17 to bond more securely to the stiffener tube.

Figure 2:
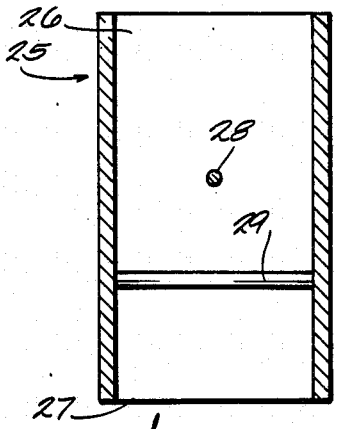
FIGS. 2–5 depict a tubular member comprising the bubbler at various stages of the bubbler fabrication.

The method of making the new bubbler and the details of its construction will now be described in reference to FIGS. 2–7. Referring to FIG. 2, the body of the bubbler is comprised of a tubular member 25 which is initially open at its upper end 26 and its lower end 27. Tubular member 25 is illustrated as having a square cross section although it could have some other shape such as circular. In this design at least two cross rods 28 and 29 are welded at their ends to the opposite walls of the tubular member 25. The purpose of these rods is to stabilize refractory material which will ultimately be cast in tubular member 25 as will be explained later.

Figure 3:
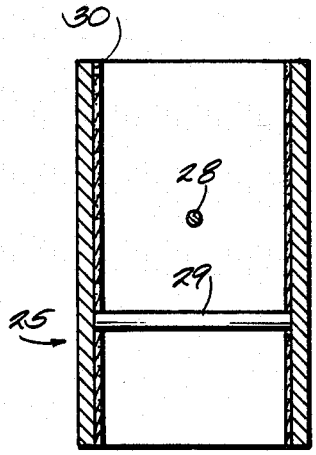

FIG. 3 illustrates the next step in the method of making the bubbler. This step consists of depositing a layer of material that can be volatilized or melted out such as paraffin or some other wax or organic material. Coating 30 is usually about 1/64 to 1/32 of an inch thick.

Figure 4:
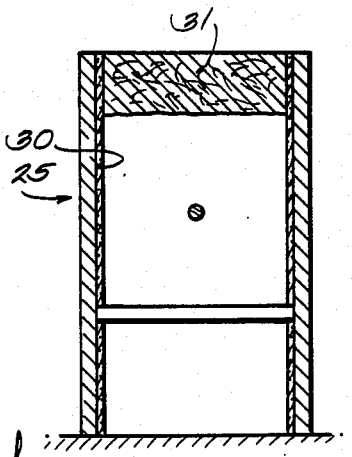

FIG. 4 illustrates the next step which is to insert a filler material 31 for the purpose of blocking one end of the tubular member 25. This can be any kind of easily removable material such as refractory fiber or the like. The material does not have to be heat resistant since it will be removed in due course. It should be noted that coating 30 could be applied to the interior walls of the tubular member 25 after filler material 31 is in place since the coating is unnecessary over the length of the member occupied by filler material 31.

Figure 5:
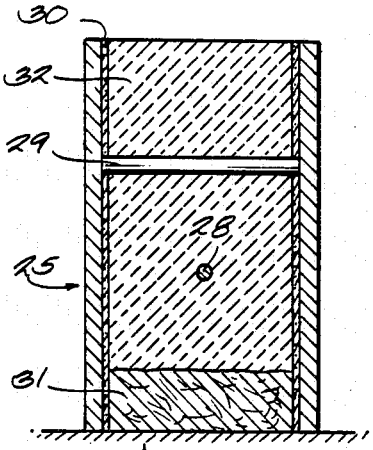

The next step as illustrated in FIG. 5 is to cast a plug 32 of refractory material in tubular member 25. The entire length of tubular member 25 is filled with the refractory material except that part of the length which is occupied by removable filler material 31. The refractory material 32 is one that can be cured at temperatures far below the temperature that prevails in a molten metal bath when the lance is in use. The refractory material 32 should preferably shrink by a small amount when it is cured and heated. Assuming that the refractory material in FIG. 5 has been cured and solidified, the next step is to heat the bubbler assembly to melt out or volatilize the coating layer 30. This leaves a small gap all the way around the refractory plug 32. Cross rods such as 28 and 29 are fastened in the tubular member 25 to assure that refractory material plug 32 will not slip out of tubular member 25 regardless of its orientation. After the refractory material 32 is solidified, filler material 31 is removed from the interior of tubular member 25.

Figure 6:
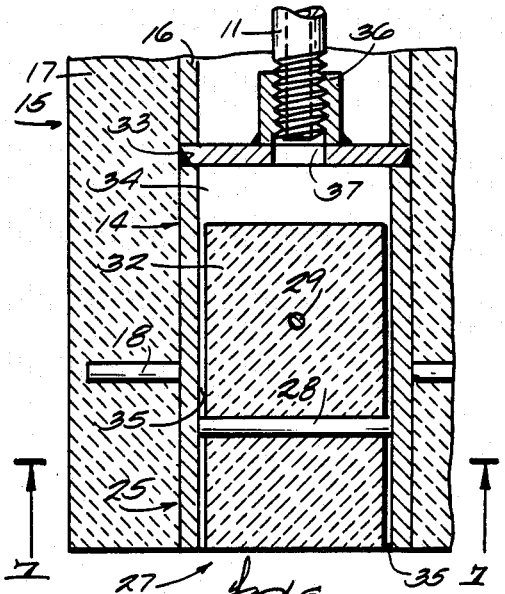
FIG. 6 is a vertical section through the finished bubbler which is shown incorporated in the gas discharge end of a stirring lance.

The finished bubbler is depicted in FIG. 6. At this stage, a capping plate 33 has been welded on the top end of tubular member 25. Since the filler 31 has been removed, an unoccupied space 34 is created between cover plate 33 and the top of refractory material block 32. Space 34 constitutes a plenum chamber for evenly distributing the incoming gas around the perimetral gap 35 which has been created by removing the coating 30 from around refractory material plug 32. A pipe coupling 36 is welded to cover plate 33 in alignment with a hole 37 in the plate and the previously mentioned gas feed pipe 11 is then screwed into coupling 36. Subsequently to attach the pipe or previously, stiffener tube 16 can be joined with the bubbler 14 by welding, for example. The outside insulative protective sheath 17 is then formed over the combined length of the stiffener tube 16 and bubbler 14.

Figure 7:
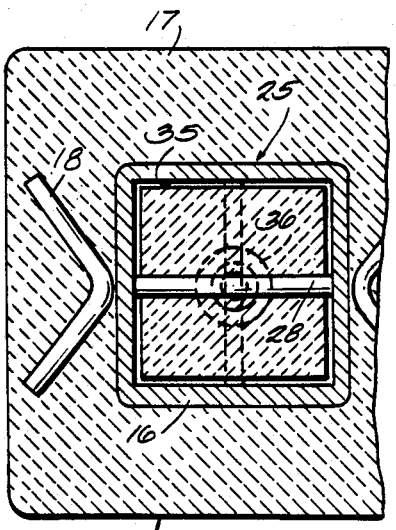
FIG. 7 is a transverse section taken through the lance along a line corresponding to 7—7 in FIG. 6.

As shown in FIG. 7, the gas discharge passageway or gap 35 is square in configuration and terminates substantially flush with the lower edge of the tubular member 25 comprising the body of the bubbler when the lance is still unused to form a loop or ring shaped continuous outlet orifice 23.

The material used for refractory plug is preferably one that shrinks slightly when it is cured and forms a gas impermeable body. In addition, the refractory selected degrades from heating and cooling during use to provide a new or fresh refractory edge 27 at the outlet orifice 23 to prevent clogging of the orifice 23. In any event, regardless of the diameter or size of the tubular member 25, the thickness of the coating 30 should be adjusted so that the final gap 35 thickness is about 1/64th to about 1/32nd of an inch. By way of example and not a limitation, in one actual embodiment, a square tubular member 25 is used which has an internal width of 2.5 inches. The wall thickness of the tubular member 25 is 0.25 of an inch. The axial length of tubular member 25 is about six inches and the depth of the plenum chamber 34 is about 0.75 of an inch.

A suitable composition for refractory plug 32 is 60% by weight of calcined kaolin, 20% by weight of bauxite and 20% by weight of calcined aluminate cement containing 80% alumina.

A desirable refractory material 32 composition is as follows:

60% by weight of calcined kaolin containing 41.6% at 4–8 mesh, 25% at 8–20 mesh and 33.33% at 20 mesh.

20% by weight of bauxite containing 50% at 12 mesh and 50% at 30–325 mesh.

20% by weight of calcined aluminate cement comprised of 80% alumina and the remainder other substances.

The gas pressure fed to the bubbler, of course, has to be great enough to overcome the ferrostatic pressure of the molten metal which will depend upon the depth in the melt at which the lower end of the bubbler is place. About one-half pound of gas pressure is used for every inch of ferrostatic head. The object is to use just enough pressure to cause the gas to emerge from the lower end of the bubbler and creep out laterally and ascend in very fine bubbles which is desirable and is attained by the new bubbler.

Tests under actual intended use conditions thus far have indicated that the new lance structure, particularly the bubbler, will have a surprisingly high life expectancy. Those that have been removed from service for study purposes after the number of usages which are typically the limit or useful life of prior art lances have been found to be in condition for longer service before replacement of the bubbler is needed. Inspection after each use has revealed that the refractory plug degrades by a small amount during each usage and that this degradation causes the edge 27 to crumble away during repeated immersions as a result of heating and cooling. This causes any slag or other foreign matter to fall from the plug face to keep the orifice 23 clean. The outer wall 15 of the lance erodes at a lesser rate and hence provides a projecting protective sheath for the more destructible plug 32 which also minimizes slag adherence in the area of the outlet 23 and results in the gas passageway gap being kept clear. Nothing needs to be done to the bubblers to prepare them for use in the next hot metal bath. Of course, the steel tubular member 25 constituting the body of the bubbler erodes just a little slower than the refractory material but this has not affected the bubbler's capability for emitting small bubbles that are uniformly distributed and that effect efficient and non-turbulent stirring of the molten metal.

Figure 8:
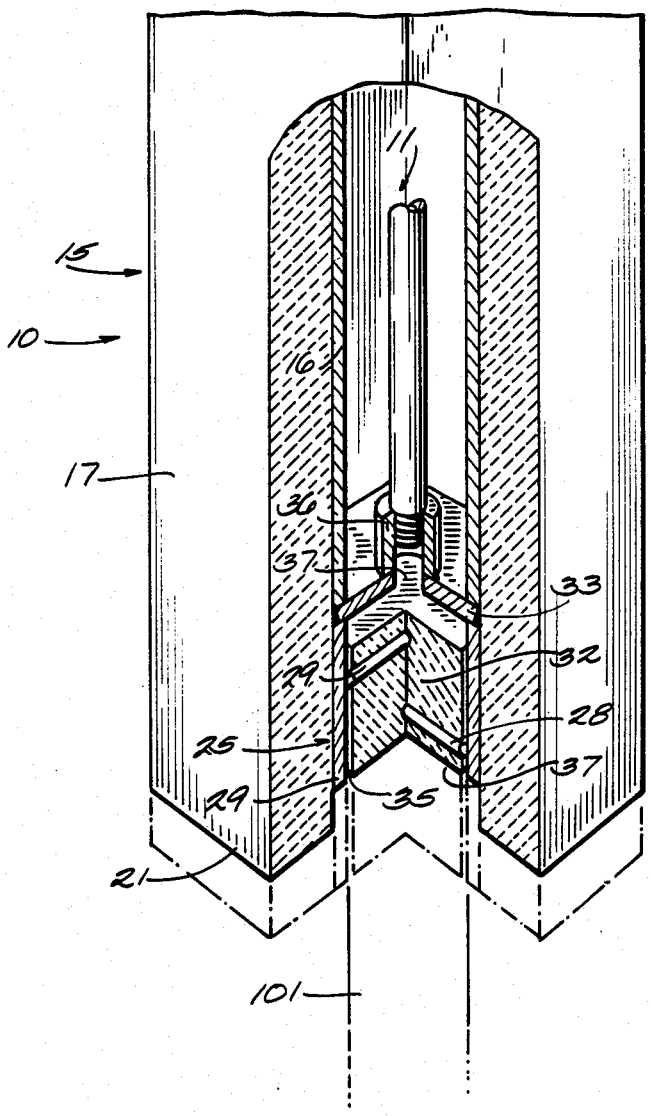
FIG. 8 is a fragmentary perspective view of the bubbler with parts broken away and after use.

FIG. 8 illustrates the end surfaces of the refractory outer wall 15. The original end 21 shown in broken lines has eroded to the full line position during use. The end 29 of tubular member 25 has also been eroded at a greater rate than end 21 as shown in full lines. Similarly the end 37 of plug 32 has eroded during use to an extent greater than end 21. This differential consumption or erosion has various advantages. The protruding walls of the lance 15 can provide a channeling effect on the gas discharge to form a beam 101 which can cause greater penetrating of the gas. Also the protruding walls of lance 15 can afford protection for the bubbler unit to increase its survival time and number of immersions. Additionally it is believed to minimize the problems of clogging of the passage 35 by slag.

We claim:

1. A method of making a gas bubbler for a molten metal stirring lance comprising the steps of:

placing a filler material at one end of a tubular member to block the tubular member at said one end, applying a thin coat of a substance to the interior surface of said tuvular member before or after said filler material is in place, said substance being one that will be driven off by heating the member, pouring into the end of said tubular material opposite of the blocked end a refractory material in a fluid state, after said refractory material is solidified heating the tubular member to drive out said substance such that a thin gas conducting passageway remains between the refractory material and said interior surface of the tubular member, removing said filler material before or after said tubular member is heated, and sealing a closure element onto said one end of the tubular member which closure element has an opening for feeding gas into the volume formerly occupied by said filler element.

2. The method according to claim 1 wherein said gas conducting passageway is between about 1/64 of an inch and about 1/32 of an inch thick.

3. The method according to any of claims 1 or 2 wherein said refractory material is comprised of about 60% by weight of calcined kaolin; 20% by weight of bauxite; and, 20% by weight of calcined aluminate cement.

* * * * *